US012680793B2

(12) United States Patent
Laporte et al.

(10) Patent No.: US 12,680,793 B2
(45) Date of Patent: Jul. 14, 2026

(54) BASE FOR A TARGET LAUNCHING MACHINE

(71) Applicant: LAPORTE HOLDING, Biot (FR)

(72) Inventors: Jean-Michel Laporte, Biot (FR); Jean-Marc Fouques, Antibes (FR)

(73) Assignee: LAPORTE HOLDING, Biot (FR)

( * ) Notice: Subject to any disclaimer, the term of this patent is extended or adjusted under 35 U.S.C. 154(b) by 199 days.

(21) Appl. No.: 18/834,278

(22) PCT Filed: Jan. 17, 2023

(86) PCT No.: PCT/EP2023/051011
§ 371 (c)(1),
(2) Date: Jul. 30, 2024

(87) PCT Pub. No.: WO2023/151906
PCT Pub. Date: Aug. 17, 2023

(65) Prior Publication Data

US 2025/0116491 A1 Apr. 10, 2025

(30) Foreign Application Priority Data

Feb. 8, 2022 (FR) ..... 2201109

(51) Int. Cl.
*F41J 9/30* (2006.01)

(52) U.S. Cl.
CPC ..... *F41J 9/30* (2013.01)

(58) Field of Classification Search
CPC .. F41J 9/18; F41J 9/24; F41J 9/30; F41J 9/32
USPC ..... 124/6, 8, 9
See application file for complete search history.

(56) References Cited

U.S. PATENT DOCUMENTS

| | | | | |
|---|---|---|---|---|
| 5,249,563 | A * | 10/1993 | Patenaude | F41J 9/30 124/8 |
| 9,448,031 | B2 * | 9/2016 | Wijegunawardana | A63B 69/406 |
| 10,488,162 | B2 * | 11/2019 | Laporte | F41J 9/30 |
| 11,733,007 | B2 * | 8/2023 | Laporte | F41J 9/32 124/6 |
| D1,103,235 | S * | 11/2025 | Laporte | D22/114 |
| 12,480,749 | B2 * | 11/2025 | Laporte | F41J 9/18 |
| 2014/0261364 | A1 * | 9/2014 | Wijegunawardana | F41J 9/32 124/78 |

(Continued)

FOREIGN PATENT DOCUMENTS

| | | |
|---|---|---|
| FR | 1125504 A | 10/1956 |
| FR | 3066813 A1 | 11/2018 |

OTHER PUBLICATIONS

International Search Report issued in PCT/EP2023/051011; mailed Mar. 30, 2023.

*Primary Examiner* — Joshua E Freeman
(74) *Attorney, Agent, or Firm* — Studebaker Brackett PLLC

(57) ABSTRACT

A target launching machine including a lower portion and an upper portion for carrying a target launching machine. The upper portion being mounted movable relative to the lower portion. The target launching machine also including an actuator for controlling the mobility of the upper portion relative to the lower portion. The lower portion includes an outer arch. The upper portion includes an inner arch nested in the outer arch. The mobility includes a rotation of the inner arch within the outer arch according to a swing axis.

20 Claims, 10 Drawing Sheets

(56) References Cited

U.S. PATENT DOCUMENTS

| | | | | |
|---|---|---|---|---|
| 2015/0204638 | A1* | 7/2015 | Frazier | F41J 9/24<br>124/6 |
| 2018/0372459 | A1* | 12/2018 | Laporte | F41J 9/18 |

* cited by examiner

BASE FOR A TARGET LAUNCHING MACHINE

TECHNICAL FIELD

The present invention relates to the field of target launching machines. It finds a particularly advantageous application in the sports shooting industry, and in particular in ball-trap shooting.

PRIOR ART

In the target shooting sector, and particularly in the ball-trap community, customers want a wide variety of shots. This implies the need for machine manufacturers to allow for a wide range of possible trajectories for the targets.

Many existing target launching machines have mobilities that allow varying the shooting angles of the targets. Thus, the machine described in the patent publication FR3066813A1 discloses a target launching machine equipped with a support enabling two mobilities at 90° to one another, by means of circle-arc shaped slides.

Hence, one object of the present invention is to provide a machine base, and a launching machine system equipped with such a base, offering an improved mobility of the machine relative to the base.

The other objects, features and advantages of the present invention will become apparent upon examining the following description and the appended drawings. It should be understood that other advantages may be incorporated.

SUMMARY

To achieve this objective, according to one embodiment, a base for a target launching machine is provided, comprising:

- a lower portion;
- an upper portion configured to carry a target launching machine, the upper portion being mounted movable relative to the lower portion;
- an actuator configured to control the mobility of the upper portion relative to the lower portion.

Advantageously, the base is such that:

- the lower portion comprises an outer arch;
- the upper portion comprises an inner arch nested in the outer arch;
- the mobility comprises a rotation of the inner arch in the outer arch according to a swing axis.

Thus, the base has a double-arch configuration allowing for an optimised displacement of the upper portion relative to the lower portion. According to one aspect, the optimisation concerns the obtainment of a larger angular amplitude, in particular to obtain extreme trajectories for the targets. According to another aspect, alternative or cumulative, the optimisation relates to a better distribution of the loads being applied on the inner arch, in particular to limit the forces that the actuator should apply.

Thus, for example, it is possible to obtain an increase in the success rate of the shooters in order to attract more customers than experienced shooters. Indeed, standard targets have a discoid shape and are provided with a domed cap and except in the trajectories overflying the shooter, the orientation of the target in flight, in practice, exposes only its lateral profile to interfere with the plumb pellets, which confers some complexity on the shots. Hence, a larger angular displacement of the machine, as made possible herein, allows increasing the area that the plumb pellets could reach.

Moreover, the arcuate shape allows having significant rigidity in a preferred direction by limiting the overall volume of the portion equipped with this arch, the lower portion or the upper portion.

Furthermore, it enables nesting of the inner arch in the outer arch, preferably forming a relatively homothetic superposition of the two arches, without substantially increasing the height of the base. In general, the lower portion of the inner arch, and preferably most of the height of the inner arch, is accommodated into the inner volume of the latter, when the inner arch is in the same plane as the outer arch.

This shape is also favourable to the largest possible displacement of the inner arch during rotation thereof.

Another aspect relates to a target launching system comprising a target launching machine and a base as described herein, the target launching machine being carried by the base.

Considering the considerable weight of the machine, mounting it on such a base advantageously enables an optimised positioning to limit the influence of the movement of the centre of gravity of the movable assembly when the machine is inclined.

BRIEF DESCRIPTION OF THE FIGURES

The aims, objects, as well as the features and advantages of the invention will appear more clearly from the detailed description of an embodiment of the latter which is illustrated by the following appended drawings, wherein.

Figure 1:
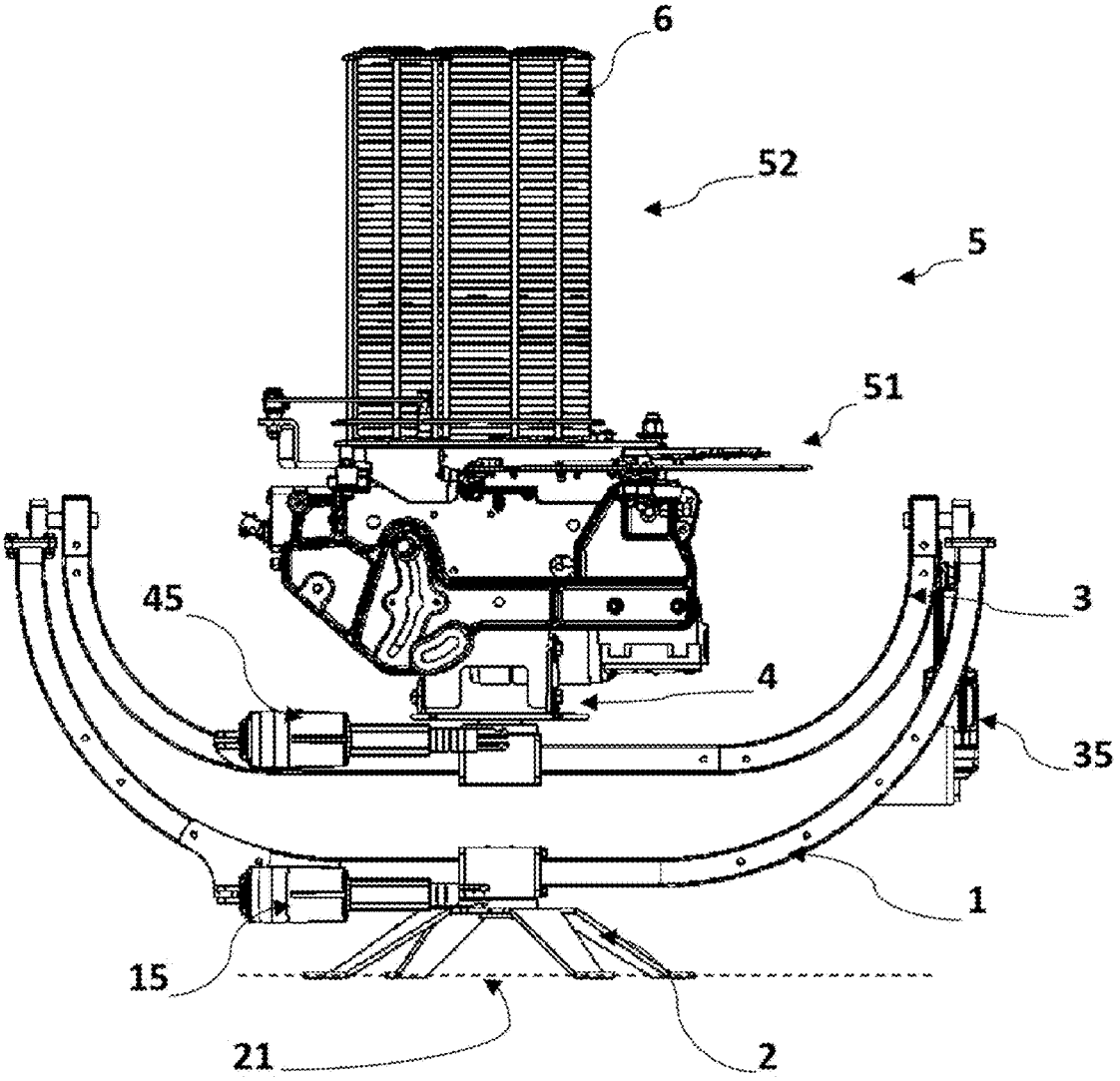
FIG. 1 shows a front-end view of a system comprising a base and a launching machine loaded with targets.

The drawings are given as examples and do not limit the invention. They consist of schematic representations of principle intended to facilitate understanding of the invention and are not necessarily plotted to the scale of practical applications.

DETAILED DESCRIPTION

Before starting a detailed review of embodiments of the invention, optional features are set out hereinafter below, which could possibly be used in association or alternatively:

- the outer arch 1 comprises a first arm 11 and a second arm 12 extending on opposite sides of the outer arch 1; wherein the inner arch 3 comprises a first arm 31 and a second arm 32 extending on opposite sides of the inner arch 3, and wherein the rotation of the inner arch 3 in the outer arch 1 is done by a first pivot between the first arm 11 of the outer arch 1 and the first arm 31 of the inner arch 3 and a second pivot, opposite to the first pivot, between the second arm 12 of the outer arch 1 and the second arm 32 of the inner arch 3;

the actuator 35 includes one end mounted on the inner arch 3 and another end mounted on the outer arch 1;

the actuator 35 is a cylinder having a stroke perpendicular to the swing axis 34;

the end of the actuator 35 is mounted on the inner arch 3 by a lever arm 353;

the base comprises a support 2 on which the outer arch 1 is mounted and in which the support 2 includes a lower support surface according to a support plane 21, and in which the swing axis 34 is parallel to the plane;

the outer arch 1 is rotatably mounted on the support 2 according to a primary axis 14, the base comprising a primary actuator 15 configured to control the rotation of the outer arch 1 relative to the support 2;

the primary axis 14 is perpendicular to the swing axis 34 and/or the primary axis 14 and the swing axis 34 are concurrent;

the inner arch 3 and the outer arch 1 are symmetrical around a plane of symmetry perpendicular to the swing axis 34;

a support 4 is mounted on the inner arch 1 and comprises a support area of the target launching machine 5;

the support 4 is rotatably mounted on the inner arch 3 according to a secondary axis 44, the base comprising a secondary actuator 45 configured to control the rotation of the support 4 relative to the inner arch 3;

the secondary axis 44 is perpendicular to the swing axis 34 and/or in which the secondary axis 44 and the swing axis 34 are concurrent;

the support 4 comprises a plurality of anchor points 47, preferably four anchor points evenly distributed at 90° around the secondary axis 44, each configured to interchangeably mount one end of the secondary actuator 45;

the secondary axis 44 is located in the plane of symmetry;

the primary axis 14 is located in the plane of symmetry;

the upper portion comprises a counterweight 37, preferably removably mounted.

the target launching machine 5 comprises a barrel 52 for storing targets, and the system comprises a maximum-load configuration in which the barrel 52 is completely filled with targets 6, and a minimum-load configuration in which the barrel 52 is completely empty of targets 6;

an assembly formed by the target launching machine 35 and the upper portion has a first centre of gravity in the maximum-load configuration and a second centre of gravity in the minimum-load configuration, the assembly having an extreme position in which the outer arch 1 and the inner arch 3 have a maximum relative angle, the swing axis 34 being located so that a value of the torque exerted by the weight of the assembly, according to the direction of the swing axis 34, in the maximum-load configuration is substantially equal to a value of the torque exerted by the weight of the assembly in the minimum-load configuration in the extreme position;

the orthogonal projection of the centre of gravity of the assembly onto the support plane 21 is located in a central third of the orthogonal projection of the support onto the support plane 21.

It is specified that, in the context of the present invention, the expression "substantially equal" should be understood as a value that is not different by more or less than 10% of another value.

The arch shape offers a concave geometry. By "nested", it should be understood the fact that the inner arch is mounted so as to be able to move in the concavity of the outer arch. Typically, this nesting is such that, when the inner arch is in a vertical plane at rest, it extends generally parallel to the outer arch, the profiles of the two arches being superposed. This does not exclude the inner arch protruding beyond the outer arch, in particular above the swing axis. In other words, when the two arches are in the same plane and brought close to one another, the inner arch is inscribed within the concave space defined by the outer arch above the latter, the concave profiles of the two arches being directed on the same side.

The invention described herein comprises a machine 5 configured to throw targets 6. These may be of the clay pigeon type, which have a circular section, in the form of a tray and which are generally used for practicing ball-trap. This application is not limiting. In particular, targets made of a polymer material for practicing archery on a moving target are another possible application.

In general, it is possible to implement a machine 5 of the current design and to attach it on the base described in detail in the remainder of the description. Typically, the machine 5 comprises a launch portion 51. In the latter, a ready-to-launch target is generally arranged on a launch plane 511 ready to be thrown by an arm 512 movable in rotation and controlled by a motor-driven arming and triggering system.

Figure 2:
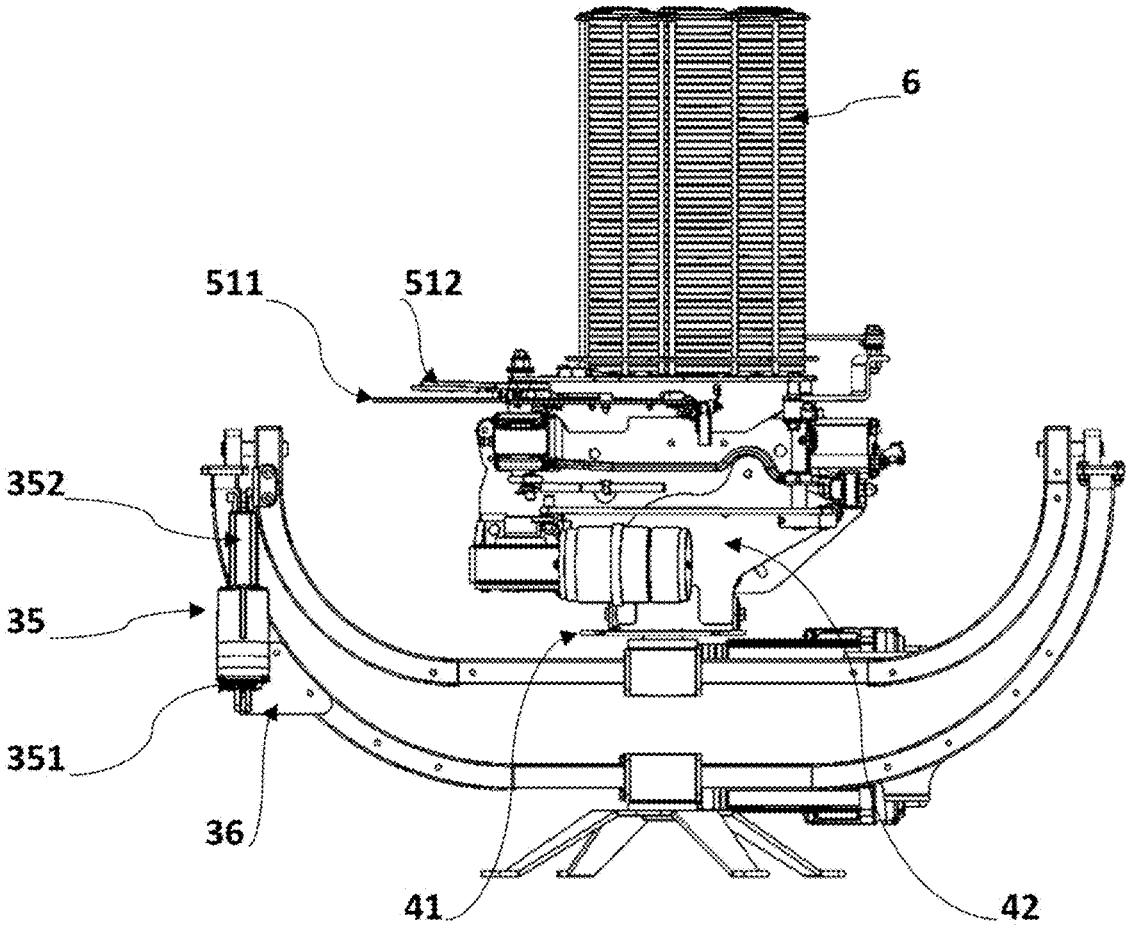
FIG. 2 shows a rear-end view of this system.

To allow repeated shooting practice, it is generally known to combine a barrel 52 with the launch portion 51. As shown in FIGS. 1 and 2, the barrel 52 is arranged above the launch portion 51 and it has means for successively delivering at least one target 6 thus unloaded, in the direction of the launch plane 511.

The barrel 52 typically comprises a plurality of columns in each of which the targets 6 may be stacked. Thus, one could typically store several tens of targets 6. One could easily understand that the weight of the machine 5 is heavy, especially when many targets are stored. For example, the weight of a vacuum machine 5 may be 70 kg and the maximum target load 30 kg. Hence, the base on which the machine 5 rests should be capable of withstanding such a weight, and that being so in different positions of the machine, to enable different shooting directions. In particular, these may include very inclined positions of the machine with respect to the base, as shown for example in FIGS. 11 and 12.

As shown in particular in the embodiment of FIGS. 1 and 2, the base herein shown comprises from a support plane 21 typically corresponding to the ground, a support 2 carrying an outer arch 1. This assembly typically belongs to a lower portion of the base. It is surmounted by an inner arch 3 mounted movable relative to the outer arch 1. The inner arch 3 itself carries a support 4 at which the machine 5 is received. Typically, the inner arch 3 and the support 4 belong to an upper portion of the base which is thus movable relative to the lower portion.

At least, there is therefore a relative rotational mobility between the arches 1, 3. FIGS. 1 and 2 show an actuator 35 allowing controlling this mobility. They also reveal a primary actuator 15 allowing controlling a relative mobility between the support 2 and the outer arch 1, as well as a secondary actuator 45 allowing controlling a relative mobility between the inner arch 3 and the support 4. Although not essential to the implementation of the invention, the primary and secondary actuators and the movements enabled thereby confer on the base a wider variety of configurations to enable very varied positions of the launching machine 5.

According to one possibility, at least one of the actuators 15, 35, 45 is a cylinder, and preferably an electric cylinder.

In particular, at least one of these cylinders may be controlled via a control interface like a remote control, and/or via a programmable device ensuring random or non-random position variations.

Figure 3:
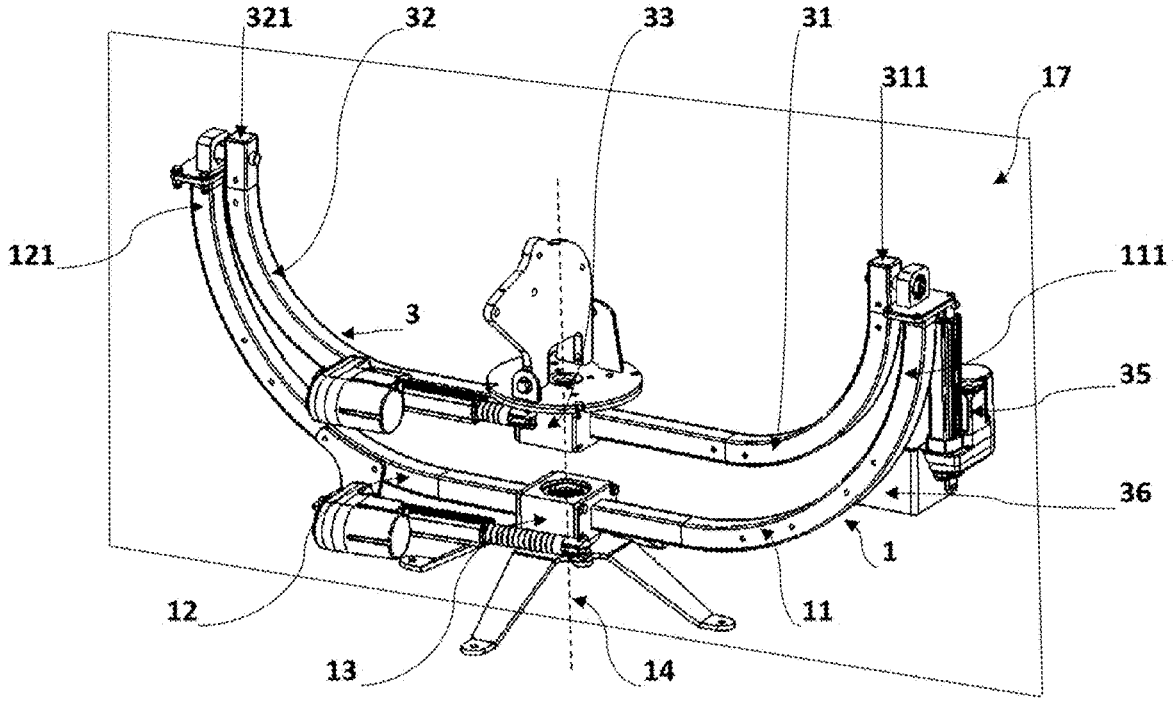
FIG. 3 shows an embodiment of the base, isolated from the machine it carries, according to a perspective.

Referring to FIG. 3, illustrating the isolated base of the machine 5, one could notice at first an embodiment of the outer arch 1. The latter may be made in the form of a profile, either in one-piece, or as an assembly of a plurality of elementary profiles. In the illustrated example, the cross-section of the outer arch is rectangular, and more specifically square.

In this example, the outer arch 1 has a first branch 11 forming a portion of its length, and a second branch 12 forming another portion of its length, the two branches being opposite one another. Still in this example and without limitation, the branches 11, 12 are fixedly connected by a junction block 13 located typically at the mid-length of the outer arch 1. As will be seen later on, the block 13 also preferably gives the possibility of ensuring a connection to the support 2.

For example, the length of the inner arch in projection onto the support plane 21 may be larger than or equal to 80 cm and/or smaller than or equal to 150 cm.

Preferably, the first branch 11 and the second branch 12 are symmetrical with respect to a plane passing through the middle of the length of the outer arch 1 and directed according to the section of the branches. It will be seen that this plane may comprise an axis of rotation 14 of the arch 1 relative to the support 2.

Preferably, the outer arch 1 also has a symmetry according to a plane 17 illustrated in FIG. 3 and extending vertically while cutting the arch 1 at the middle of its width.

Preferably, the branches 11, 12 and the block 13 are made of a material or based on a metallic material, such as steel. The configuration in the form of arcuate profiles of the branches allows using hollow elements limiting the weight of the arch 1. At the same time, a satisfactory rigidity is ensured.

The outer arch 1 defines, between these two distal ends 111, 121, a concavity directed upwards forming a displacement space for the upper portion, and in particular for the inner arch 3.

Figure 4:
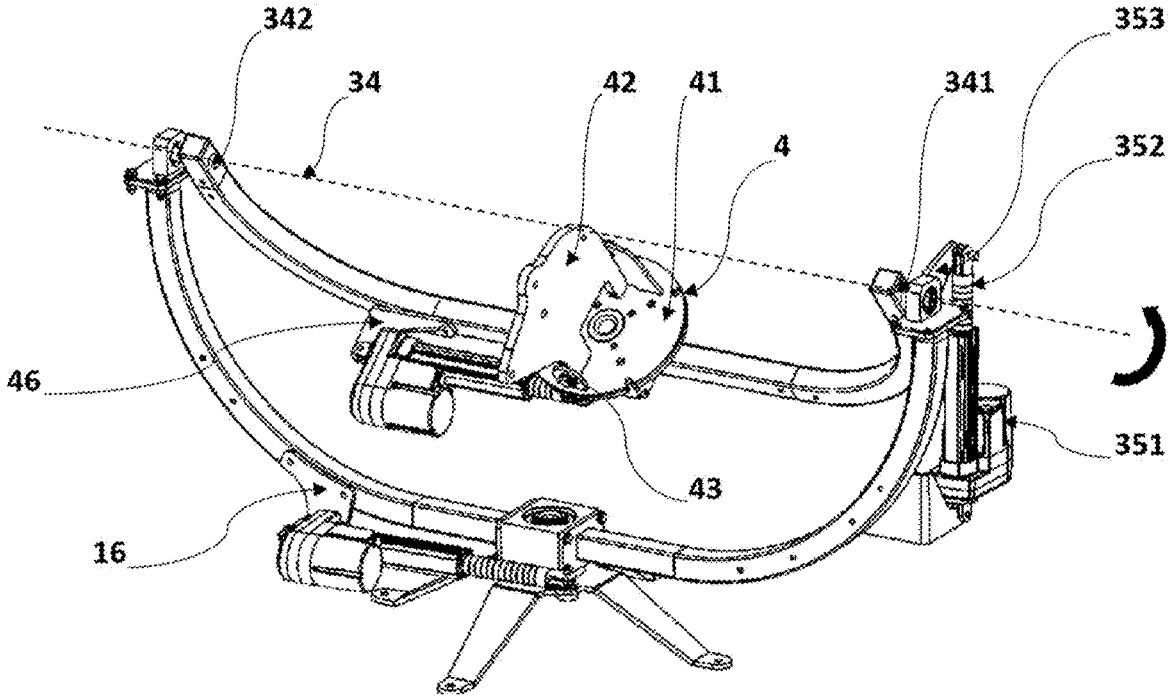
FIG. 4 shows the base in the embodiment of the preceding figure, with an inclination of the inner arch.

This displacement is enabled about a swing axis 34 schematised in FIG. 4; typically, the axis 34 is horizontal in a usual position of use; at least, it is advantageously parallel to the ground, i.e. to the support plane 21. Swinging is produced by the articulation of the inner arch 3 relative to the outer arch 1 at the two distal ends of these arches. In particular, one end 311 of the inner arch 3 is connected to one end 111 of the outer arch 1 through a pivot connection which may be materialised by a shaft 341. On the opposite side, another end 321 of the inner arch 3 is connected to another end 121 of the outer arch 1 through another pivot connection which may be materialised by a shaft 342.

Reference may be made to the description of the outer arch 1 for examples of details of possible embodiment for the inner arch 3; in particular for the selection of materials, the geometry and making in the form of profiles. In particular, the arch 3 may include a first branch 31 and a second branch 32 fixedly connected via a junction block 33 advantageously located at the centre of the inner arch 3 and opposite the junction block 13 in the situation of FIG. 3.

The length, in projection onto the plane 21, of the inner arch 3 is smaller than that of the outer arch 1 so that the branches of the outer arch 1 surround the branches of the inner arch 3.

According to a height direction, the inner arch 3 extends predominantly, and even totally, between these two ends so as to be located in the concavity of the outer arch 1 when it is directed in the plane 17, as shown in FIG. 3. In this situation, the concavity of the inner arch 3 is directed in the same direction as that of the outer arch 1, meaning that the two arches are nested. According to the possibility illustrated in FIG. 3, it should be noted that a basal portion of each of the arches, at the junction blocks, is rectilinear, so that the two arches are parallel at this level according to a direction parallel to the axis 34.

As indicated before, the rotation about the axis 34 is performed by an actuator 35. FIGS. 3 and 4 allow visualising this control through a movement of the rod 352 of this actuator 35 relative to its body 351. In the illustrated case, one end of the actuator 35 is mounted on the outer arch 3, herein via a mounting part 36 fastened on the arch 3. The opposite end of the actuator is mounted on the inner arch 1, and, in this example, via a lever arm 353. While the rod 352 is retracted in the case of FIG. 3, it is at least partially deployed in the case of FIG. 4 so as to impart a rotation of the inner arch 3 according to the movement of the arrow of FIG. 4.

Figure 11:
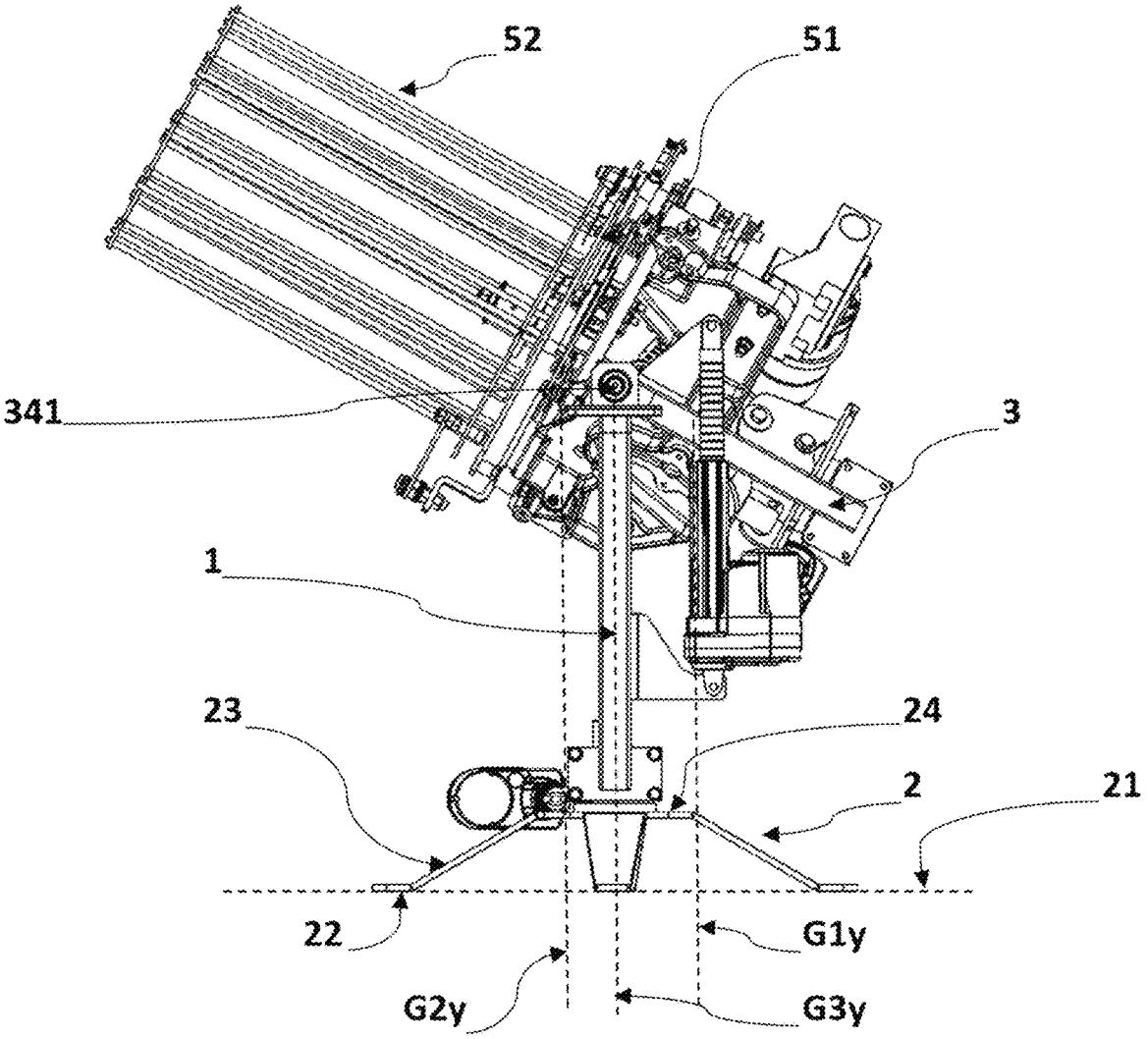
FIG. 11 illustrates a profile view of an indicative extreme position that could be reached thanks to the invention.
Figure 12:
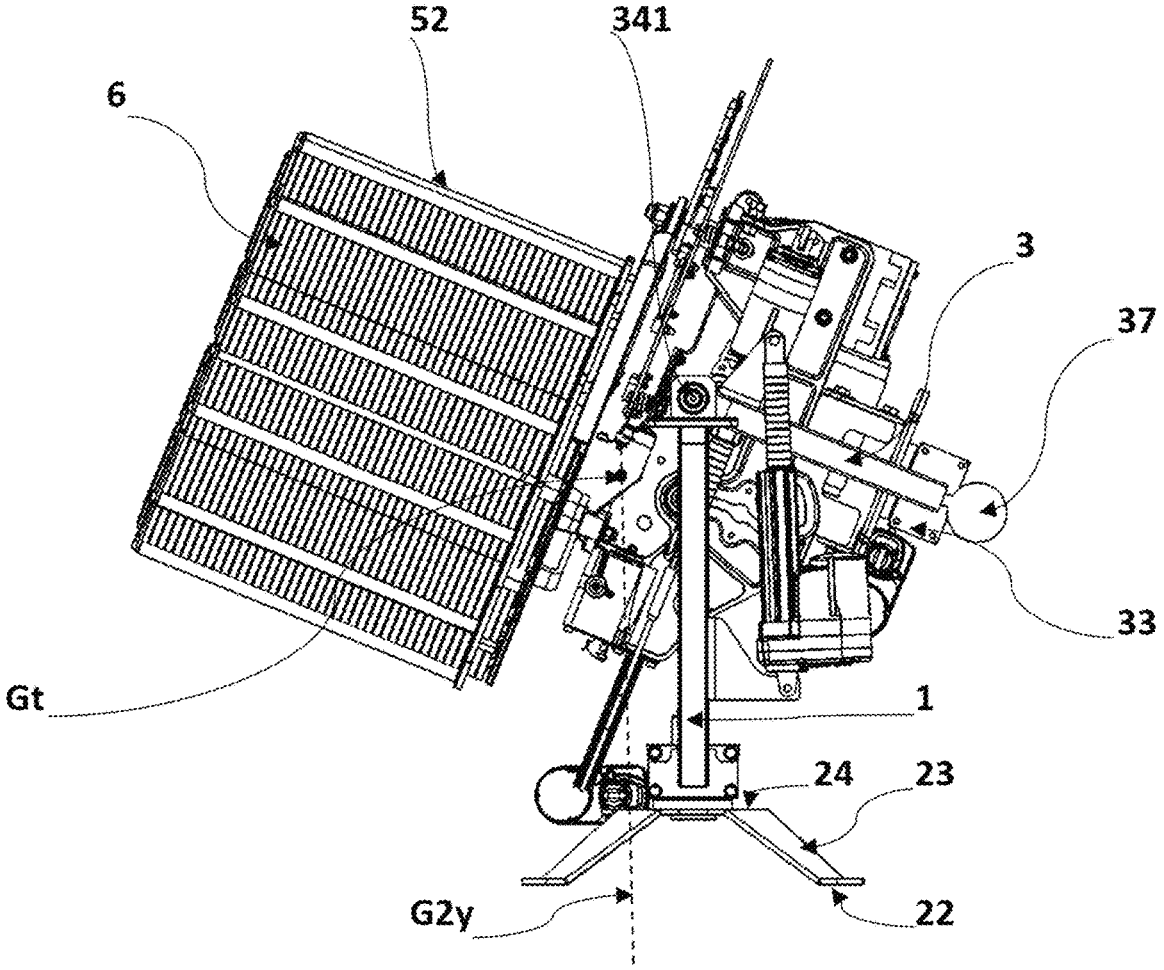
FIG. 12 shows an embodiment with a counterweight.

This arrangement enables a degree of freedom between the lower portion and the upper portion of the base, to make the inclination of the machine vary according to the direction 34. For example, FIG. 11 and FIG. 12 give two examples of the result produced by this inclination, in which examples the arch 3 has a non-zero angle with respect to the arch 1. The inclination that can be reproduced is not limited, but could cover a displacement ranging up to 80° around the vertical position shown in FIG. 3.

To drive the machine 5 in this inclination, the base includes a support 4 carried by the inner arch 3. As shown in FIG. 4 in particular, the support 4 may have a tray 41 supported by the junction block 33 as well as a post 42 projecting from the upper surface of the tray 41, the machine being advantageously fastened to the post 42, in particular by screwing. Preferably, a pivot 43 allows adjusting the inclination between the post 42 and the tray 41, thereby conferring an additional adjustment capability on the orientation of the machine 5.

Figure 5:
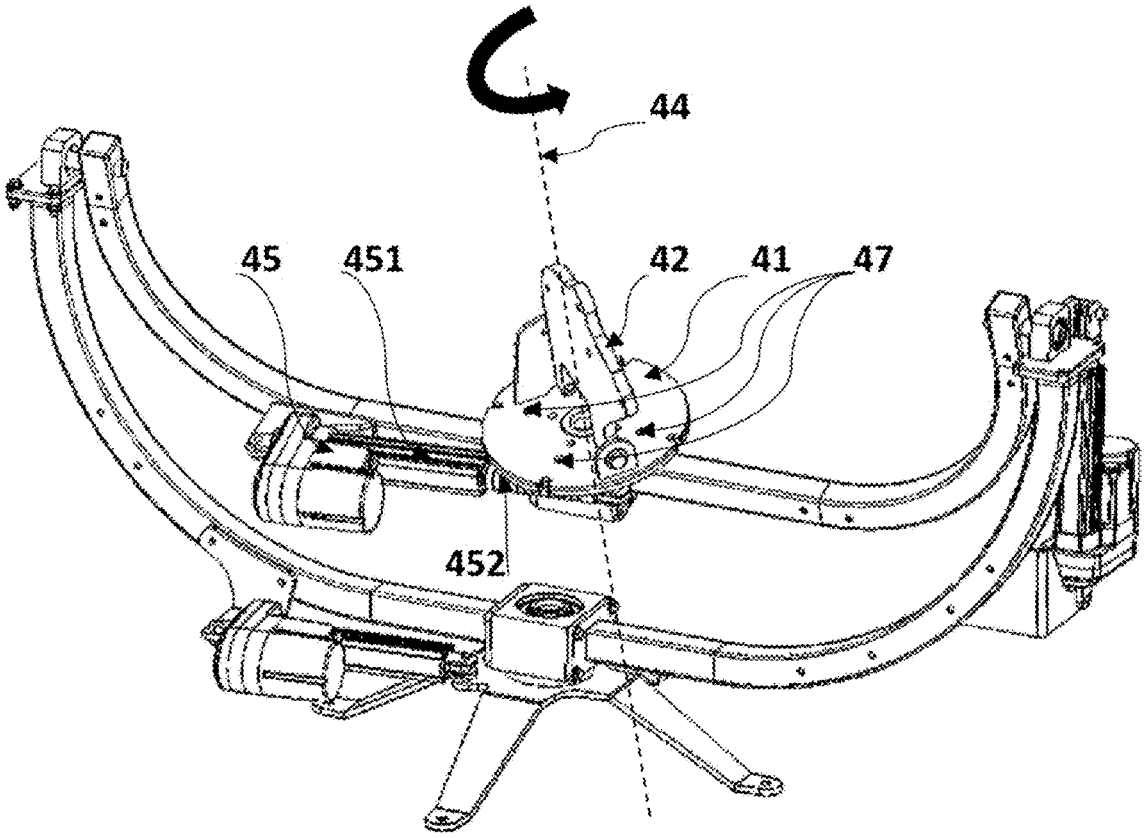
FIG. 5 shows an example of mobility of a support of the base.

Preferably, the support 4 is rotatably mounted on the inner arch 3, about an axis 44 visible in FIG. 5. Moreover, this rotation is controlled by the actuator 45. One end of the actuator 45 is mounted on the inner arch 3, as is the case for the body 451 of the actuator 45 in the figures, while the other end of the actuator 45 is mounted on the support 4, as is the case with the rod 452 in the figures. It should be understood that a translational displacement of the rod 452 allows modifying the angular position of the support 4 relative to the inner arch 3. This is revealed by the position variations as shown in particular in FIGS. 4, 5 and 6 and the arrows illustrating the rotation in FIGS. 5 and 6.

Figure 6:
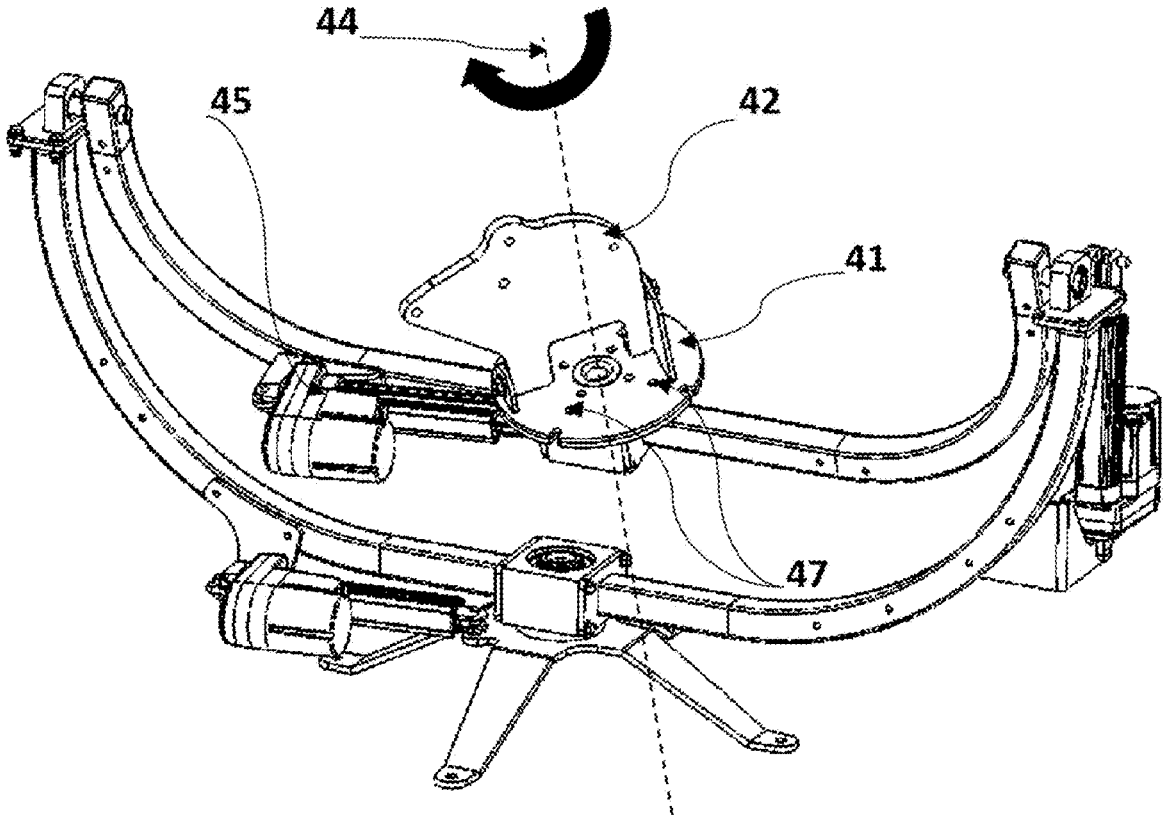
FIG. 6 is a second illustration of this support mobility.

According to an advantageous option, the actuator 45 may be mounted on the support 4 at different locations of the tray 41 corresponding to the anchor point 47 referenced in FIGS. 5 and 6. For example, by simple screwing and unscrewing operations, it is possible to modify the rotational displacement angular sector of the support 4 relative to the inner arch 3 and that being so, for a limited actuator 45 stroke. For example, if the stroke is configured to be able to produce a displacement of 90°, positioning four anchor points 47 spaced apart by 90° on the tray 41 enables a 360° movement capability of the support 4 relative to the arch interior 3.

To guide this rotation, a pivot is preferably positioned at the centre of the plate 41 opposite the junction block 33.

Figure 7:
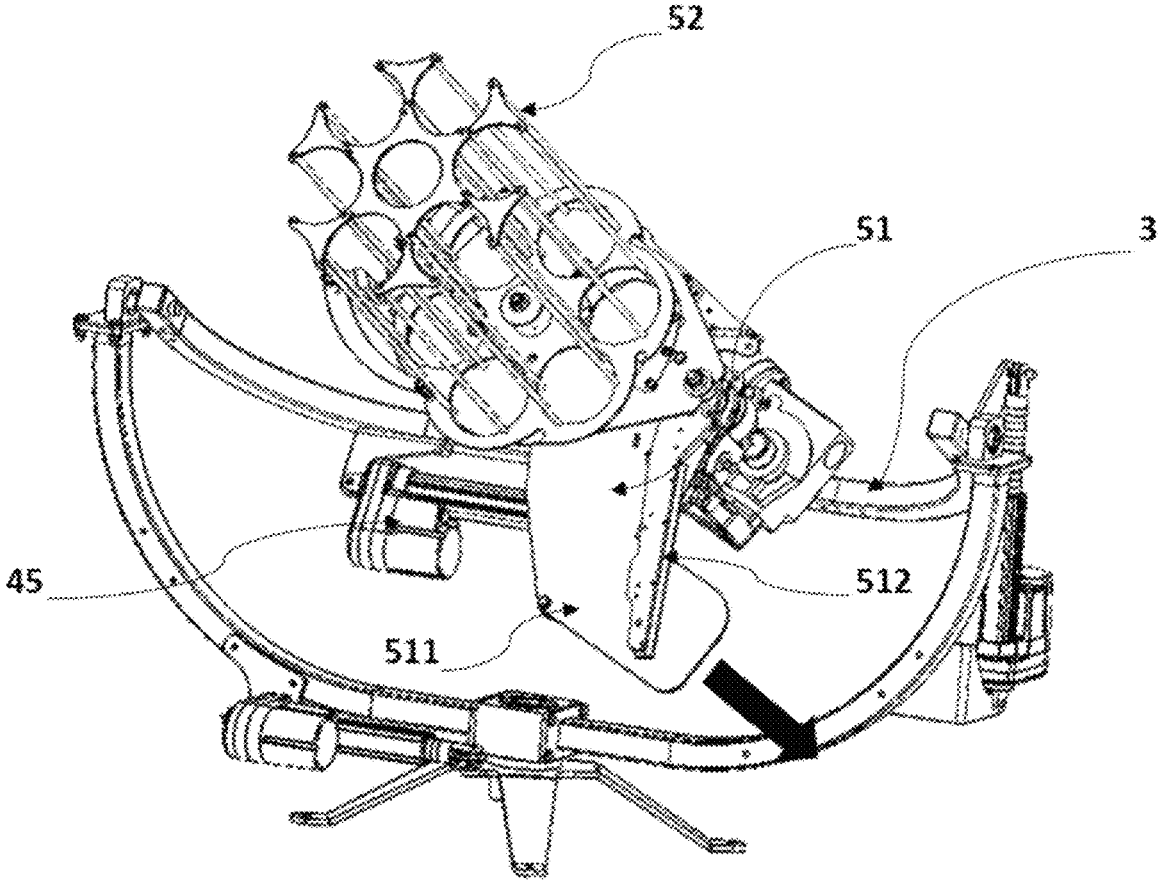
FIGS. 7 to 9 show a plurality of possible non-limiting shooting positions by acting on the mobilities of the base.

FIG. 7 shows an example of orientation of a machine 5 thanks to the base of the invention. In particular, the arrow that is visible therein shows that it is possible to throw a target 6 by the arm 512 in a very inclined manner downwards, the launch plate 511 being very inclined in this case.

Figure 8:
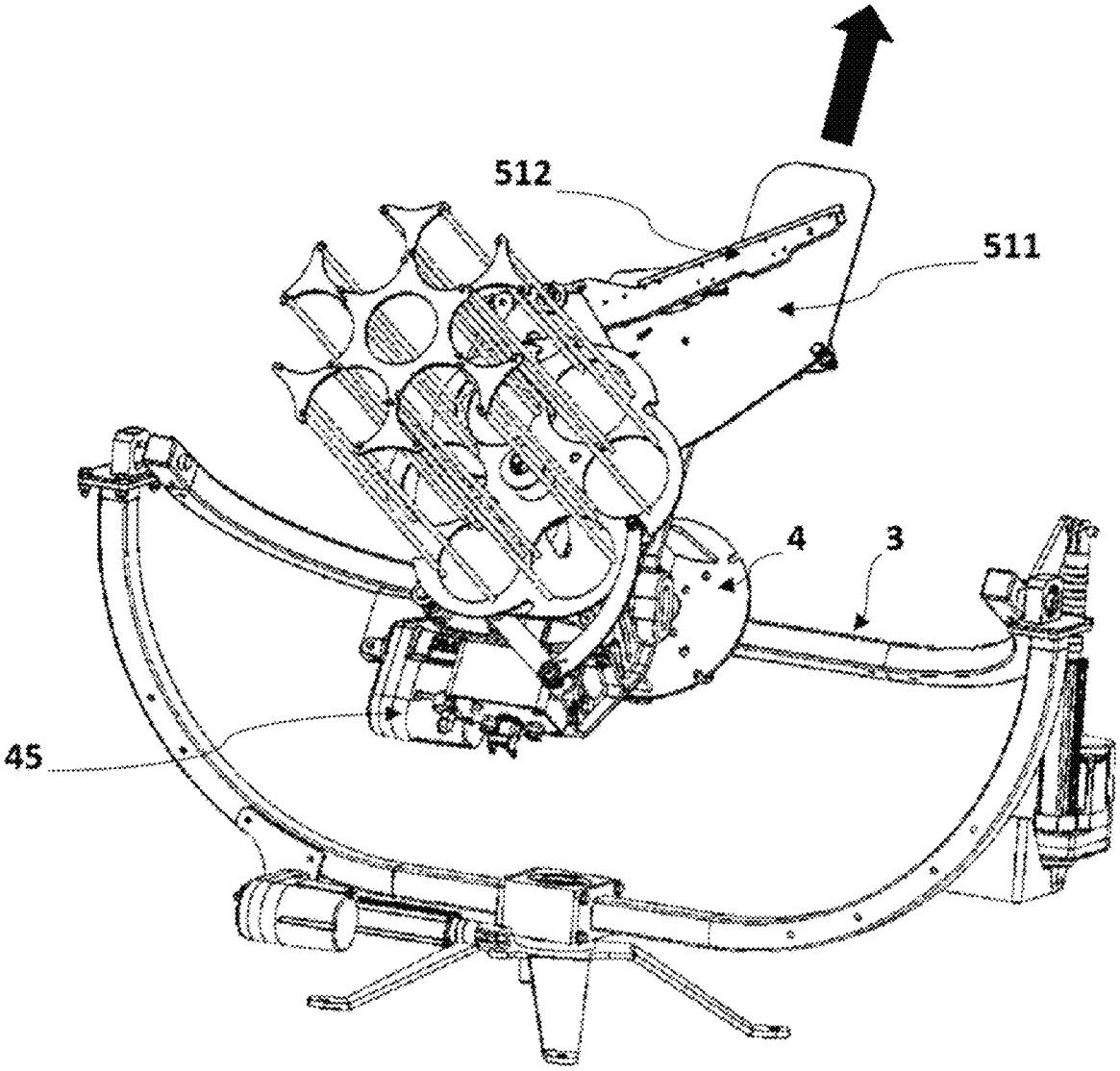
Figure 9:
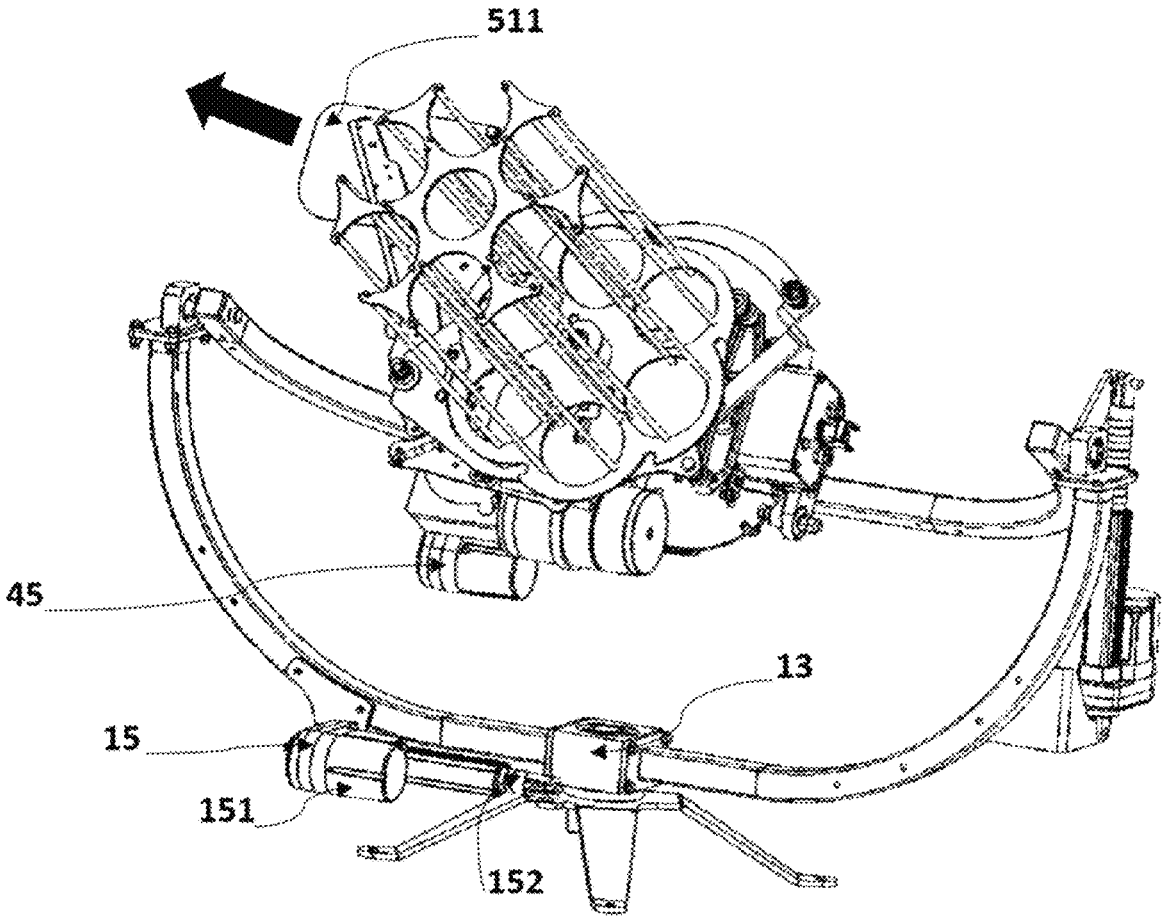

With the same inclination of the inner arch 3, FIG. 8 shows an orientation that is very different from the shot direction by an arrow directed substantially upwards, the support 4 having been rotated by the actuator 45 relative to the position of FIG. 7. Still for example, FIG. 9 shows, by an arrow, another shot direction with another orientation of the support 4 produced by the actuator 45 possibly through a modification of the anchor point of the latter.

Figure 10:
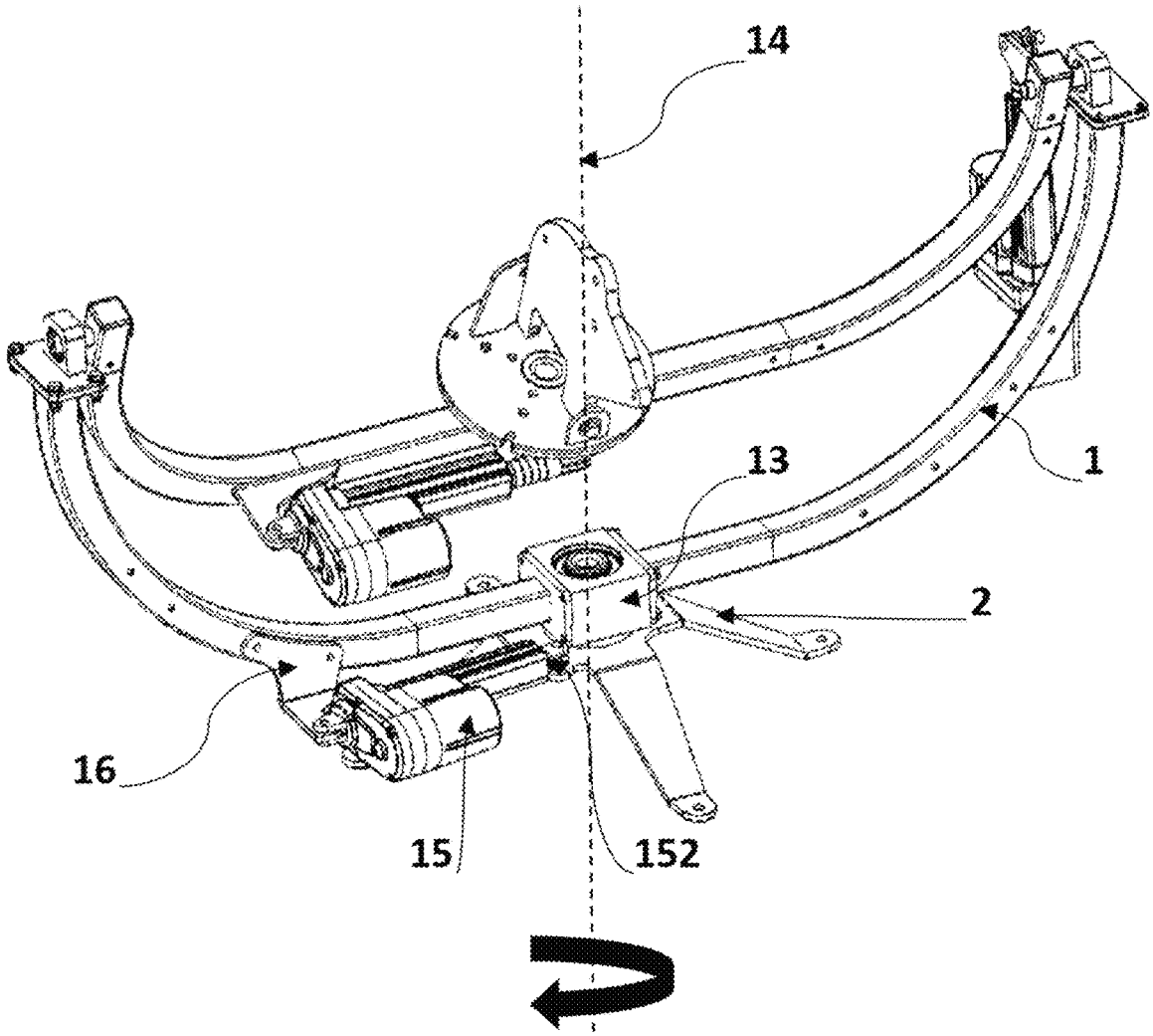
FIG. 10 reveals the mobility relative to a support.

FIG. 10 schematises another optional movement capability, between the support 2 and the outer arch 1. As mentioned before, a rotational mobility is advantageously enabled between these two portions about an axis 14. To this end, a pivot connection is organised between the support and the junction block 13 and the actuator 15 ensures control of the rotation. Like before, a first end of the actuator 15, herein that one of the body 151 of the actuator 15, is mounted on the outer arch 1, herein via a mounting part 16 while the other end, herein that one of the rod 152, is mounted on the support 2. The produced movement is illustrated by the arrow in FIG. 10.

For example, it is possible to enable an angular displacement substantially equal to 90°.

In the case of the different figures, the support 2 includes a plurality of feet 23 extending from a central area 24 to tabs 22 configured to form a support surface of the support 2 on the support plane 21, these reference numerals being visible in FIG. 11.

Preferably, a flat support is formed between the tabs 22 and the plane 21. Preferably, the feet 23 have an inclination comprised between 20° and 60° with respect to the support plane 21.

Preferably, the central area 24 extends according to a plane parallel to the support plane 21.

Still advantageously, the axis 14 is perpendicular to the support plane 21. And the plane 17 of the outer arch preferably comprises the axis 14. Thus, the lower portion of the base is centred in its movement with respect to the support 2.

Moreover, FIG. 11 shows that the base allows optimising the relative position of the machine 5 and of the base to reduce the involved forces. In particular, the axis 34 may be judiciously placed at an intermediate height level of the machine 5 so as to distribute the weight of the latter around the axis 34 by forming a balance effect.

For example, it is possible to consider a configuration of the assembly formed by the machine and the upper portion of the base corresponding to a maximum load, i.e. when the barrel 52 is completely filled with targets 6. This maximum-load configuration adds the fixed weight of the machine and of the upper portion, for example a total substantially equal to 70 kg, and that of a full loading of targets, for example substantially equal to 30 kg, corresponding to a maximum load of 100 kg. Conversely, a minimum-load configuration corresponds to a situation in which the barrel is empty of targets, equivalent for example to a total load of 70 kg.

It should be understood that the position of the centre of gravity of this assembly evolves when the machine is inclined. Therefore, the force moment exerted by its weight on the lower portion of the base also varies, by switching from a minimum value around a position in which the inner arch 3 is directed in the plane 17 into a maximum value when the inner arch 3 is in an extreme inclination position, for example in the case of FIG. 11.

Besides placing the axis 34 at an intermediate position according to the height of the machine, which is enabled by the inner arch 3, whose concavity allows receiving a lower portion of said machine, it is also possible to refine the position of the axis 34 so as to avoid an excessive variation of the torque caused by the weight of the assembly between the maximum-load and minimum-load configurations.

To this end, the ratio between the weight of the assembly and the distance between a vertical axis G3y passing through the axis 34 and a vertical axis G2y and G1y passing through the centre of gravity of the assembly should be kept identical, respectively in the maximum-load configuration and in the minimum-load configuration.

In the example of a maximum load of 100 kg and a minimum load of 70 kg, FIG. 11 shows a determination of a distance between G3y and the two directions G1y and G2y such that:

$$[G1yG3y] * 70 = [G2yG3y] * 100.$$

According to a more approximate option, one could simply place the axis 34 at least between the directions G2y and G3y.

Moreover, it is possible to arrange for the projection onto the support plane 21 of the direction G2y (vertical direction passing through the centre of gravity of the assembly formed by the machine at the upper portion of the base in the maximum-load configuration) being always inscribed within the surface of the central area 24 of the support 2. The latter area 24, thus ingeniously sized, ensures good stability, to the extent that the unbalance of the machine is never too eccentric so that there is no risk of tilting thereof. Thus, it is possible to best size the footprint surface of the support 2, which, surprisingly, could be relatively reduced thanks to the invention and the optimisation of the placement of the centre of gravity of the movable elements with respect to the lower portion of the base.

FIG. 12 also reflects this arrangement, with the centre of gravity Gt of the assembly in the maximum-load configuration, and the direction G2y which remains inscribed within the surface of the central area 24.

FIG. 12 shows another option of the invention in the form of a counterweight 37. Indeed, the maximum load of the assembly carried by the lower portion of the base can evolve, either when varying loading of the barrel 52, or according to the type of machine that can be carried by the base. Indeed, the machines do not all have the same weight. The counterweight 37 may equip the assembly carried by the arch 1 and in particular it may be mounted on the inner arch 3.

According to the example of FIG. 12, the counterweight 37 is fastened to the junction block 33.

Preferably, in order to achieve a balance effect with respect to the upper portion of the machine 5, the counterweight 37 is located at the lower portion of the inner arch 3.

According to an additional possibility, the position of the counterweight is adjustable in height, so as to vary its influence in terms of force moments on the entire load produced by the assembly carried by the base. According to another possibility, cumulative or alternative, the counterweight made removable on the base, so as to be able to use it only when necessary and/or so as to be able to mount a counterweight having the mass the most suited to the situation.

The invention is not limited to the previously-described embodiments.

REFERENCE NUMERALS

1. Outer arch
11. First arm
12. Second arm
13. Junction block
14. Primary axis
15. Primary actuator
151. Body
152. Rod
16. Mounting part
17. Plane
2. Support
21. Support plane
22. Tab
23. Foot
24. Central area
3. Inner arch
31. First arm
311. Distal end
32. Second arm
321. Distal end
33. Junction block
34. Swing axis
341. First shaft
342. Second shaft
35. Actuator
351. Body
352. Rod
353. Lever arm
36. Mounting part
37. Counterweight
4. Support
41. Tray
42. Post
43. Pivot
44. Secondary axis
45. Secondary actuator
451. Body
452. Rod
46. Mounting part
47. Anchor points
5. Machine
51. Launch portion
511. Launch plane
512. Arm
52. Barrel
6. Target

The invention claimed is:

1. A ball trap target launching system, comprising a target launching machine provided with a launch portion having a launch plane on which a target to be thrown is intended to be arranged and an arm movable in rotation and controlled by a motor-driven arming and triggering system, the launching system also comprising a base, the target launching machine being carried by the base, wherein the target launching machine comprises a target storage barrel, the system comprising a maximum-load configuration in which the barrel is completely filled with targets, and a minimum-load configuration in which the barrel is completely empty of targets, and wherein the base for the target launching machine comprises:

a lower portion;

an upper portion configured to carry a target launching machine, the upper portion being mounted movable relative to the lower portion; and an actuator configured to control the mobility of the upper portion relative to the lower portion;

wherein:

the lower portion comprises an outer arch;

the upper portion comprises an inner arch nested in the outer arch; and the mobility comprises a rotation of the inner arch in the outer arch according to a swing axis.

2. The system according to claim 1, wherein an assembly formed by the target launch machine and the upper portion has a first centre of gravity in the maximum-load configuration and a second centre of gravity in the minimum-load configuration, the assembly having an extreme position in which the outer arch and the inner arch have a maximum relative angle, the swing axis being located so that a value of the torque exerted by the weight of the assembly, according to the direction of the swing axis, in the maximum-load configuration is substantially equal to a value of the torque exerted by the weight of the assembly in the minimum-load configuration in the extreme position.

3. The system according to claim 2, further comprising a support on which the outer arch is mounted and wherein the support includes a lower support surface according to a support plane, and wherein the swing axis is parallel to the support plane, said base wherein an orthogonal projection of the centre of gravity of the assembly onto the support plane is located in a central third of the orthogonal projection of the support onto the support plane.

4. The system according to claim 1, wherein the outer arch comprises a first arm and a second arm extending on opposite sides of the outer arch; wherein the inner arch comprises a first arm and a second arm extending on opposite sides of the inner arch, and wherein the rotation of the inner arch in the outer arch is done by a first pivot between the first arm of the outer arch and the first arm of the inner arch and a second pivot, opposite to the first pivot, between the second arm of the outer arch and the second arm of the inner arch.

5. The system according to claim 1, wherein the actuator includes one end mounted on the inner arch and another end mounted on the outer arch.

6. The system according to claim 5, wherein the actuator is a cylinder having a stroke perpendicular to the swing axis.

7. The system according to claim 4, wherein the end of the actuator is mounted on the inner arch by a lever arm.

8. The system according to claim 1, further comprising a support on which the outer arch is mounted and wherein the support includes a lower support surface according to a support plane plane, and wherein the swing axis is parallel to the support plane.

9. The system according to claim 8, wherein the outer arch is rotatably mounted on the support according to a primary axis, the base comprising a primary actuator configured to control the rotation of the outer arch relative to the support.

10. The system according to claim 9, wherein the primary axis is perpendicular to the swing axis and/or the primary axis and the swing axis are concurrent.

11. The system according to claim 1, wherein the inner arch and the outer arch are symmetrical around a plane of symmetry perpendicular to the swing axis.

12. The system according to claim 11, further comprising a support mounted on the inner arch, and comprising a support area of the target launching machine, wherein the support is rotatably mounted on the inner arch according to a secondary axis, the base comprising a secondary actuator configured to control the rotation of the support relative to the inner arch, and wherein the secondary axis is located in the plane of symmetry.

13. The system according to claim 11, further comprising a support on which the outer arch is mounted and wherein the support includes a lower support surface according to a support plane, and wherein the swing axis is parallel to the support plane, and wherein the outer arch is rotatably mounted on the support according to a primary axis, the base comprising a primary actuator configured to control the rotation of the outer arch relative to the support, and wherein the primary axis is located in the plane of symmetry.

14. The system according to claim 1, further comprising a support mounted on the inner arch, and comprising a support area of the target launching machine.

15. The system according to claim 14, wherein the support is rotatably mounted on the inner arch according to a secondary axis, the base comprising a secondary actuator configured to control the rotation of the support relative to the inner arch.

16. The system according to claim 15, wherein the secondary axis is perpendicular to the swing axis and/or wherein the secondary axis and the swing axis are concurrent.

17. The system according to claim 15, wherein the support comprises a plurality of anchor points, each anchor point configured to interchangeably mount one end of the secondary actuator.

18. The system according to claim 17, wherein the support comprises four anchor points evenly distributed at 90° around the secondary axis.

19. The system according to claim 1, wherein the upper portion comprises a counterweight.

20. The system according to claim 19, wherein the counterweight is removably mounted.

* * * * *